US005388814A

United States Patent [19]

Riemscheid et al.

[11] Patent Number: 5,388,814

[45] Date of Patent: * Feb. 14, 1995

[54] DEVICE FOR HYDRAULIC EXPANSION

[75] Inventors: Helmut Riemscheid; Herbert Frielingsdorf, both of Lohmar; Heribert Grewe, Overath; Karl Weiss, St. Augustin; Rudolf Schulze, Much; Engelbert Schwarz, Ruppichteroth; Helmut Swars, Bergisch Gladbach; Arnold Palussek, Engelskirchen, all of Germany

[73] Assignee: Emitec Gesellschaft für Emissionstechnologie mbH, Lohmar, Germany

[ * ] Notice: The portion of the term of this patent subsequent to Oct. 8, 2008 has been disclaimed.

[21] Appl. No.: 80,998

[22] Filed: Jun. 22, 1993

Related U.S. Application Data

[60] Continuation of Ser. No. 722,084, Jun. 27, 1991, abandoned, which is a division of Ser. No. 639,315, Jan. 8, 1991, Pat. No. 5,054,756, which is a continuation of Ser. No. 305,865, Mar. 17, 1989, abandoned.

[30] Foreign Application Priority Data

May 21, 1987 [DE] Germany ..... 3716986

[51] Int. Cl.[6] ..... B23B 31/40

[52] U.S. Cl. ..... 269/48.1

[58] Field of Search ..... 269/22, 48.1, 48.3; 242/72 R, 72 B; 279/2 A, 4; 294/93, 98.1; 82/44

[56] References Cited

U.S. PATENT DOCUMENTS

| | | | |
|---|---|---|---|
| 3,388,916 | 6/1968 | Winnen et al. | 269/48.1 |
| 4,253,694 | 3/1981 | Walter et al. | 279/2 A |
| 4,317,577 | 5/1982 | Cameron | 279/2 A |
| 4,368,996 | 1/1983 | Davis et al. | 269/48.1 |
| 4,616,392 | 10/1986 | Snyder | 269/48.1 |
| 4,624,184 | 11/1986 | Katz et al. | 269/48.1 |
| 4,840,323 | 6/1989 | Nakajima | 279/2 A |

FOREIGN PATENT DOCUMENTS

| | | | |
|---|---|---|---|
| 1131486 | 6/1962 | Germany | 279/2 A |

*Primary Examiner*—Robert C. Watson

*Attorney, Agent, or Firm*—Anderson Kill Olick & Oshinsky

[57] ABSTRACT

A device for the simultaneous hydraulic expansion of a plurality of longitudinal portions of a hollow shaft for the production of force-locking and/or positive-locking connections between the latter and elements slid thereon, (such as cams, toothed wheels or bearing seats), in the form of a pressure medium probe. This comprises at least one longitudinally extending feed channel and radial feed bore holes to every longitudinal portion of the hollow shaft to be expanded, which is characterized by a sealing arrangement which seals longitudinal portions of the hollow shaft remaining undeformed against the action of the pressure medium from longitudinal portions of the hollow shaft to be expanded. These lie between them wherein the probe includes a one-piece probe body with annular grooves arranged in a spaced manner, wherein expansion arrangements are received by the grooves and an expansion arrangement includes a one-piece expansion sleeve which covers the entire expansion area; it can be acted upon from the inside by pressure medium along substantial portions of its length and is radial expandable, wherein its surface contacts the inner surface of the hollow shaft during the hydraulic expansion of the hollow shaft.

8 Claims, 1 Drawing Sheet

DEVICE FOR HYDRAULIC EXPANSION

Figure 1A:
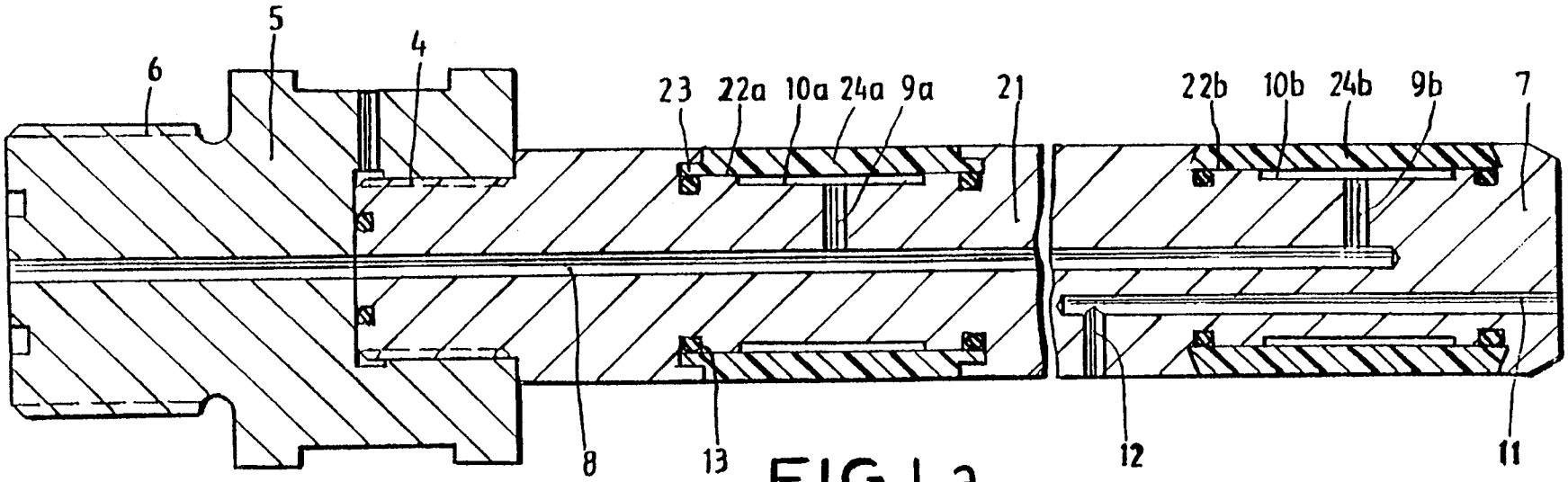

This is a continuation application of Ser. No. 07/722,084, filed Jun. 27, 1991, now abandoned, which in turn is a divisional application of Ser. No. 07/639,315, filed Jan. 8, 1991, now U.S. Pat. No. 5,054,756, which in turn is a continuation application of Ser. No. 07/305,865, filed Mar. 17, 1989, now abandoned, which is the U.S. Phase of PCT/DE88/00301, filed May 20, 1988.

DESCRIPTION

The invention is directed to a device for the simultaneous hydraulic expansion of a plurality of longitudinal portions of a hollow shaft for the production of force-locking and/or positive-locking connections between the latter and elements slid thereon, such as cams, toothed wheels or bearing seats. The device has the form of a pressure medium probe comprising a longitudinally extending feed channel and radial feed bore holes to every longitudinal portion of the hollow shaft to be expanded, and possibly comprising a longitudinally extending discharge channel and radial discharge bore holes to the portions of the hollow shaft remaining undeformed between the respective longitudinal portions of the hollow shaft which are to be expanded. Sealing means are provided at the probe which seal the longitudinal portions of the hollow shaft remaining undeformed relative to the action of the pressure medium from the longitudinal portions of the hollow shaft to be expanded which lie between them.

Devices, according to the aforementioned principle, comprising a single longitudinal portion defined by a sealing arrangement, which longitudinal portion can be sealed relative to the pipe interiors and can be acted upon by pressure medium, are known in the field of hydraulic expansion of pipes which are to be fastened in pipe bases of steam generators. Such devices are not suitable for the aforementioned area of use due to the complicated positioning when there is a plurality of expansion portions located one after the other and because of the process connected with this which, in its entirety, is long.

The principle of a device with a plurality of longitudinal portions which are sealable relative to the pipe interiors is prescribed in connection with the aforementioned object, wherein simple O-rings inserted in grooves are used as sealing elements, which O-rings are not suitable in this form for the aforementioned area of use (P 35 30 600.9).

In the construction of a device with a plurality of expansion portions for the aforementioned area of use, the special range of problems consists in that devices must be made available for series production whose seals withstand the occurring hydraulic pressures in the order of magnitude of several thousand bar at least for the duration of a shift, i.e. for several hundred to several thousand expansion processes, and which are suitable under the aforementioned conditions for bridging and sealing a reliable seal at every expansion point, also when the interior of the hollow shaft is uneven and, in particular, not perfectly axial. Preferably, an easy exchange and replacement of the worn sealing elements of the device should be possible after the service life has expired. The object of the present invention is to provide such a probe.

In order to meet this object, devices with expansion arrangements are indicated, according to the independent patent claims, which possess sealing means, which are improved in a novel manner and have a longer service life, and which in part allow seals which are continuous along the circumference and have suitable shapes and accordingly an improved action and simultaneously facilitate the exchange of worn sealing elements.

According to the suggested process, a pressure medium is fed to every expansion arrangement via the longitudinally extending feed channels and via the individual radial feed bore holes, so that all expansion areas of the hollow shaft are acted upon by pressure and deformed in a plastic manner simultaneously. The leakage water which, depending on the constructional type of sealing means, reaches into the intermediate areas between the expansion areas outside the probe into the hollow shaft is to be guided out via radial discharge bore holes located in these areas and via a shared longitudinally extending discharge channel, so that no pressure buildup or unwanted deformation of the hollow shaft occurs in these areas.

According to the present invention, the expansion arrangement comprises a one-piece expansion bush which covers the entire expansion area, can be acted upon from the inside by pressure medium over substantial portions of its length and is radially expandable in its entirety, wherein for the purpose of hydraulic expansion of the hollow shaft, its surface contacts the inner surface of the latter. The advantage of such a construction of the expansion areas consists in an improved possibility for sealing, wherein the required radial distance can be bridged easily with a suitable selection of work material for the expansion sleeves. The sealing areas are not formed at the relatively uneven inner surface of the hollow shaft, so that for this reason alone harder materials can be used. The sealing can be effected at the outer edge areas relative to the probe body and/or at the end faces, according to the labyrinth type seals, relative to the abutting spacer sleeves. In this way, the leakage water can also be guided out without reaching the inner wall of the hollow shaft. An annular space of small radial thickness located within the expansion bushes can be formed as an internal chamber in the sleeve or as a recess on the probe base body. In this case, other recesses can also be provided in the probe base body as receptacles for additional sealing elements without diverging from the basic idea of the invention.

The sealing effect can be maintained regardless of a radial expansion by means of a groove-spring engagement at the butt joint of the sealing elements or a splicing diagonal relative to the axis or diagonal relative to the tangential line of the ring.

The invention is based on a device for the simultaneous hydraulic expansion of a plurality of longitudinal portions of a hollow shaft of the type named in the beginning, in which the probe comprises a one-piece probe body with periodically arranged annular grooves which receives the pressure medium feed channels and the pressure medium discharge channels. A possible first construction is characterized in that expansion arrangements are received by wide grooves, which expansion arrangements communicate with the feed bore holes, wherein an expansion arrangement consists in each instance of a one-piece rubber-elastic expansion sleeve covering the entire expansion area, which expansion sleeve can be acted upon by pressure medium from the inside along substantial portions of its length and is radially expandable in its entirety and is sealed relative to the probe body in its end areas, wherein its surface contacts the inner surface of the hollow shaft for the hydraulic expansion of the latter. According to this solution, a probe is shown whose basic construction is substantially simplified and in which the sealing elements are less expensive to produce at the cost of a slightly more expensive assembly, since the probe base body can be produced without special fits or threads. An improved seal between the expansion sleeve and the probe base body is to be brought about in that the annular groove is undercut at the end faces in longitudinal section, i.e. is widened e.g. in the manner of a dovetail indent or a pawl.

According to each of the aforementioned variants, the base body of the expansion sleeve can be provided with a reinforcing insert e.g. consisting of a ribbon-like sheet metal spiral or coiled wire or in the manner of a wire framework, so that the expansion is effected in a uniform manner along the length.

Additional details of the invention shown above in their various possibilities are provided in the following descriptions of the drawings.

FIG. 1*a* shows a device with a one-piece probe base body with annular grooves with expansion sleeves with one-piece expansion sleeves.

Figure 1B:
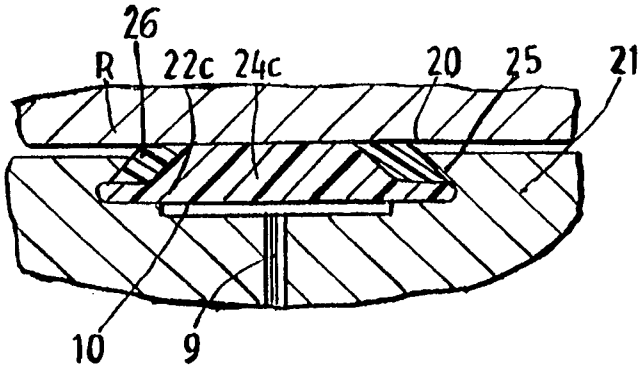

FIG. 1*b* shows a partial view of another embodiment of a built-up probe according to the invention;

FIG. 1*a* shows a probe, according to the invention, having a probe base body 21 of substantially uniform diameter in two different embodiments. A thread 4, on which a connection piece 5 is screwed, which in turn comprises an external thread 6 for connecting with a pressure line of a pressure generating device, is provided at one end of the base body. The base body 1 comprises a thickened probe head 7 at its other end. The connection piece 5 and the base body 1 are penetrated by a central feed channel 8 from which proceed radial feed bore holes 9 which open into recessed annular spaces 10 below the expansion sleeves 2. The probe comprises a discharge channel 11 in an eccentric manner, radial discharge bore holes 12, which open out below the spacer pieces 3, proceed from the discharge channel. The expansion sleeves 24 are sealed by means of O-rings 13 which are inserted in annular grooves.

According to FIG. 1*a*, the probe base body comprises two annular grooves 22 having different cross sections which are inserted directly into the probe body. The annular groove 22*a* has grooves 23 at its flanks in which an expansion sleeve 24 engages in the manner of a pawl. Below the expansion sleeve 24, an annular space of small radial thickness is recessed into the probe base body and communicates with a feed bore hole 9 which proceeds from the central feed channel 8. The expansion sleeve 24 preferably consists of inelastic work material. The same applies substantially for the annular groove 22*b* having a cross section of trapezoidal shape in which the expansion sleeve 24 is inserted.

FIG. 1*b* shows another construction as a detail, in which construction the dovetail-like cross-sectional shape of the groove 22*c* is more sharply pronounced, wherein the flanks have pronounced tips 25. Reinforcements 26 consisting of plastic substance or plastics material are inserted in the area of these tips and prevent the rubber-elastic sleeve 24*c* under high pressure from flowing away into the gaps between the hollow body R and the probe base body 21 indicated here.

We claim:

1. A device for the simultaneous hydraulic expansion of a plurality of longitudinal expansion areas of a hollow shaft, said hollow shaft having an inner surface for the production of force-looking and/or positive-locking connections between the latter and elements slid thereon, such as cams, toothed wheels or bearing seats, in the form of a pressure medium probe comprising:

at least one longitudinally extending feed channel and radial feed bore holes to every longitudinal expansion area of the hollow shaft to be expanded;

annular grooves arranged in a spaced manner on said probe, said probe comprising a one-piece probe body; and expansion arrangements received by the grooves wherein said expansion arrangement comprises a one-piece expansion sleeve which covers the expansion area and can be acted upon from the inside by pressure medium along substantial portions of its length and is radial expandable, wherein its surface form—lockingly engages the inner surface of the hollow shaft during the hydraulic expansion of the hollow shaft.

2. The device of claim 1, wherein each expansion sleeve is divided along the circumference and is arranged at an angle relative to the tangential lines.

3. The device of claim 2, wherein every expansion sleeve comprises metallic work material material of high inherent rigidity.

4. Device according to claim 1, wherein every expansion sleeve is continuous along the circumference and comprises rubber-elastic materials.

5. The device of claim 4, wherein every expansion sleeve engages in undercut end faces of the annular grooves.

6. Device according to claim 4, characterized in that the end areas of the expansion sleeves (24) are grasped by means of external supporting bodies of high inherent rigidity which are divided along the circumference.

7. Device according to claim 5, characterized in that the end areas of the expansion sleeves (24) are grasped by means of external supporting bodies of high inherent rigidity which are divided along the circumference.

8. The device of claim 2, wherein every expansion sleeve comprises plastics work material of high inherent rigidity.

* * * * *